United States Patent [19]

Gray

[11] Patent Number: 4,679,468

[45] Date of Patent: Jul. 14, 1987

[54] POWER DRIVEN TRACK SHOE SPIKE SOCKET WRENCH

[76] Inventor: Barbara J. Gray, 14014 Goldenwood, San Antonio, Tex. 78249

[21] Appl. No.: 339,295

[22] Filed: Jan. 15, 1982

[51] Int. Cl.[4] ..... B25B 13/06; B25B 21/00

[52] U.S. Cl. ..... 81/121.1; 81/176.15; 81/57.11

[58] Field of Search ..... 81/121 A, 121 R, 90 R, 81/90 C, 90 D, 121.1, 124.2, 176.1, 176.15, 57.11; 36/129, 134, 67 R, 67 A, 67 B, 67 C, 67 D; 12/103

[56] References Cited

U.S. PATENT DOCUMENTS

| | | | |
|---|---|---|---|
| 817,090 | 4/1906 | Pfeiffer | 81/121 A X |
| 1,998,921 | 4/1935 | Brown | 36/134 X |
| 2,509,980 | 5/1950 | McCallum | 81/121 R X |
| 2,581,095 | 1/1952 | Godmaire | 81/121 R X |
| 3,532,012 | 10/1970 | Pryor | 81/121 R X |
| 3,932,904 | 1/1976 | Nilsson et al. | 81/57.11 X |

*Primary Examiner*—Frederick R. Schmidt
*Assistant Examiner*—Debra S. Meislin
*Attorney, Agent, or Firm*—Cox & Smith Incorporated

[57] ABSTRACT

A socket wrench for rotating track shoe spikes including a first body member having an axial aperture formed therein of substantially circular shape to allow insertion of the spike portion of the track shoe spike, a geometric aperture disposed in the axial aperture of the first body member for engaging the base portion of a track shoe spike, and a second body member fixedly attached to the first body member for engagement by a turning tool chuck.

6 Claims, 5 Drawing Figures

POWER DRIVEN TRACK SHOE SPIKE SOCKET WRENCH

BACKGROUND OF THE INVENTION

The present invention relates to a socket wrench, and more particularly to a socket wrench specially adapted for engaging and turning track shoe spikes. The socket is designed to fit in a turning tool chuck, such as an electric drill chuck.

Track shoe spikes are manufactured in various lengths for different track surfaces and events. Prior to the start of a meet, it has been incumbent upon the track coach or track meet participants to remove all of the spikes from their track shoes and replace those spikes with suitable spikes for the surface involved. Moreover, during the track meet it frequently becomes necessary to change from one type of spike to another for different events in the track meet. For example, quarter-inch spikes are used for most jumping events, while half-inch to five-eighths-inch spikes are used for running events.

It, of course, has long been known to attach spikes to shoes through the use of threaded portions on a spike mating with threaded sockets disposed in show soles, for example as disclosed in U.S. Pat. Nos. 1,998,921 to J. C. Brown, 2,509,980 to R. M. McCallum, and 12,644 to C. Pfeiffer. Further, as shown in those patents, it is known to use various manually operated socket wrenches to rotate the spikes. It is, of course, also known to use a wrench head with various engaging surfaces, for example as shown in U.S. Pat. Nos. 2,465,048 to Wentling and 2,581,095 to Godmaire. None, however, offer the particular features and advantages of the present invention.

As more fully disclosed in the foregoing patents, track shoe spikes typically have a threaded portion which mates with a threaded socket embedded in the track shoe soles. To aid in rotating the spikes into and out of the socket, spikes typically have a flattened portion near the base of the spike. That flattened portion may be engaged with common pliers, wrenches, or slotted tools enabling rotation of the spike, and consequentially removal or insertion of the spike.

What typically happens, however, is that the wrenches or slotted tools supplied with the spikes are lost, or, through use, become so distorted that they are unusable. Such wrenches or slotted tools also tend to destroy the flattened gripping portions of the spikes and generally end up destroying or seriously damaging the spike itself. As a result, coaches and track meet participants have generally resorted to using locking pliers or Vice-Grips to engage and rotate the spikes. Beyond that using such tools is a time-consuming, laborious task, the locking pliers or Vice-Grips jaws mangle and crush the spikes rendering the spikes useless.

Therefore, in the past, it has been necessary to manually rotate the spikes into and out of their respective sockets using wholly inadequate tools which result in destroying the spikes. Consequently, many spikes must be discarded well before their useful life. Although the problems inhering in changing track shoe spikes has existed for many years, no one, prior to the present Applicant, has been able to come up with a solution to that pressing problem.

The present invention obviates the problems of the past by providing a unique socket designed to be rotated by a power driven turning tool, such as an electric drill, and enables quick and efficient changing of track shoe spikes. For the first time, coaches and meet participants may use a power driven tool for changing their spikes, which tool fits snuggly about the gripping surfaces of the spikes and does not injure the gripping surfaces or the spikes. The time-consuming, laborious process of the past has been eliminated by the present invention.

SUMMARY OF THE INVENTION

The present invention comprises a socket wrench for turning track shoe spikes which includes a first body member having an axial aperture formed therein designed to fit over the spike portion of typical track shoe spikes. A means for engaging the flattened base or gripping portions of typical track shoe spikes is disposed in the open end of the axial aperture. A second body member is fixedly attached to the first body member opposite the axial aperture opening which permits engagement by a turning tool chuck, for example an electric drill. Indeed, an ideal turning tool for use with the present invention is a rechargeable-reversable electric drill.

The socket of the present invention is secured in the electric drill chuck and disposed over a track shoe spike such that the engaging means in the open end of the axial aperture in the first body portion of the socket engages the flattened or gripping portions of the track shoe spike. With the electric drill in the forward position, the spike will be rotated clockwise, thus allowing the spikes to be quickly and effeciently rotated into the threaded sockets carried in track shoe soles. With the electric drill in the reverse position, spikes may be readily removed, by counterclockwise rotation.

Thus, it is an object of the present invention to provide a novel power-driven socket wrench for rotating track shoe spikes so as to insert and remove the same from track shoe soles with a minimum of effort and time.

It is a further object of the present invention to provide a socket wrench which functions easily and efficiently in changing track shoe spikes.

It is also an object of the present invention to provide a socket wrench of simple, economical design capable of massmanufacturing techniques.

Other objects, features, and advantages of the invention will become evident in light of the following detailed description, viewed in conjunction with the referenced drawings, of a preferred exemplary wrench according to the invention. The foregoing and following description of the invention is for exemplary purposes only. The true spirit and scope of the invention is set forth in the appended claims.

DETAILED DESCRIPTION OF THE DRAWINGS

Figure 1:
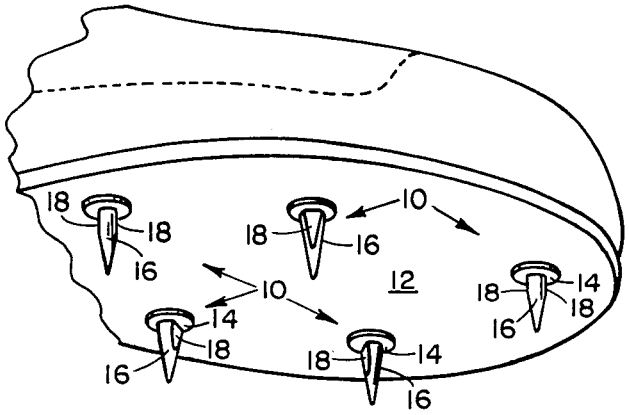
FIG. 1 is a perspective view of a standard track shoe sole showing standard track shoe spikes disposed therein.

Referring to FIG. 1, typical track shoe spikes 10 are carried in a track shoe sole 12. Track shoe spikes 10 comprise circular flat collars 14 and conical spike portions 16. The base portions of conical portions 16 have flattened or gripping portions 18 near the base of the spike, adjacent collars 14.

Figure 2:
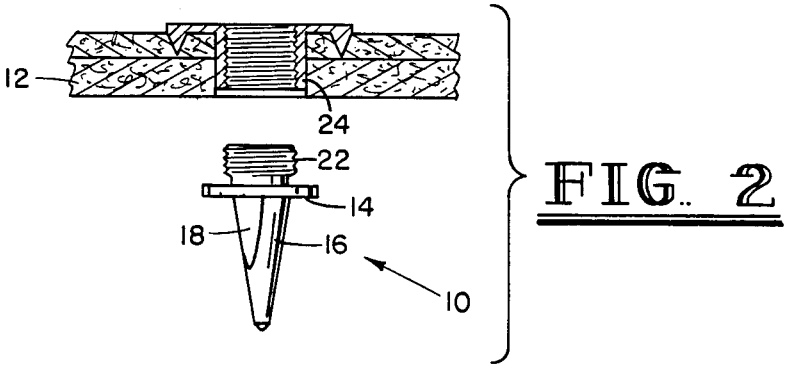
FIG. 2 is a sectional view of the socket disposed in the track shoe sole and a side elevational view of the spike just prior to engagement of the socket and spike.

As shown in FIG. 2, spikes 10 have a threaded base 22 adapted to be received in threaded socket members 24 disposed in sole 12.

Figure 3:
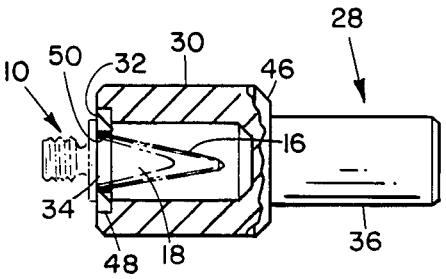
FIG. 3 is a longitudinal sectional view of the socket wrench of the present invention.

Referring to FIG. 3, the socket wrench of the present invention 28 comprises a first body member 30 having an axial aperture 32 formed therein of a substantially circular shape to allow insertion of the spike or conical portion 16 of spikes 10 (shown in phantom line). The exterior surfaces of first body member 30 are preferably cylindrical, however, other shapes may be used.

First body member 30 mates with a second body member 36. Second body member 36 has an outside shape adapted for engagement by a turning tool chuck, for example the chuck of an electric drill.

Body members 30 and 36 may either be formed integrally or may be formed as separate portions and fixedly secured or attached one to the other.

Extending inwardly from the walls of axial aperture 32, at the open end thereof, and along parallel chords of the axial aperture, are two opposing substantially flat faced surfaces 34 which are spaced diametrically from the diameter of axial aperture 32. Faces 34 are spaced so as to allow a tight engagement with gripping or flat surfaces 18 of spikes 10. Opposing face surfaces 34 extend along parallel cords of axial aperture 32.

Figure 4:
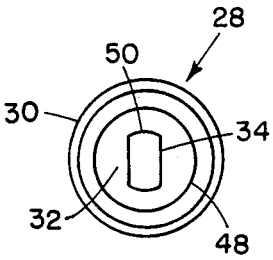
FIG. 4 is a left-end view of the socket of the present invention shown in FIG. 3.

Referring to FIG. 4, the two opposing substantially flat faced surfaces 34 are joined by two opposing arcuate surfaces 50 at the ends thereof. The geometrical aperture formed by the two opposing substantially flat faced surfaces 34 and two opposing arcuate surfaces 50 form a geometrical aperture generally matching the geometrical shape of the base portion of track shoe spikes 10. Thus socket 28 provides firm positive engagement over a substantial area of the engaging surfaces of spikes 10.

In manufacture, surfaces 34 should be constructed of hardened or high-carbon tool steel, for example having a Rockwell hardness of 55–60 to prevent deformation. Surfaces 34 and 50 may either be formed integrally with first body portion 30 or, for economical production, a circular insert 48 may be formed of high-carbon tool steel and secured to the open end of axial aperture 32 by welding or brazing. The use of such insert allows the remainder of socket wrench 28 to be constructed from low carbon steel.

Figure 5:
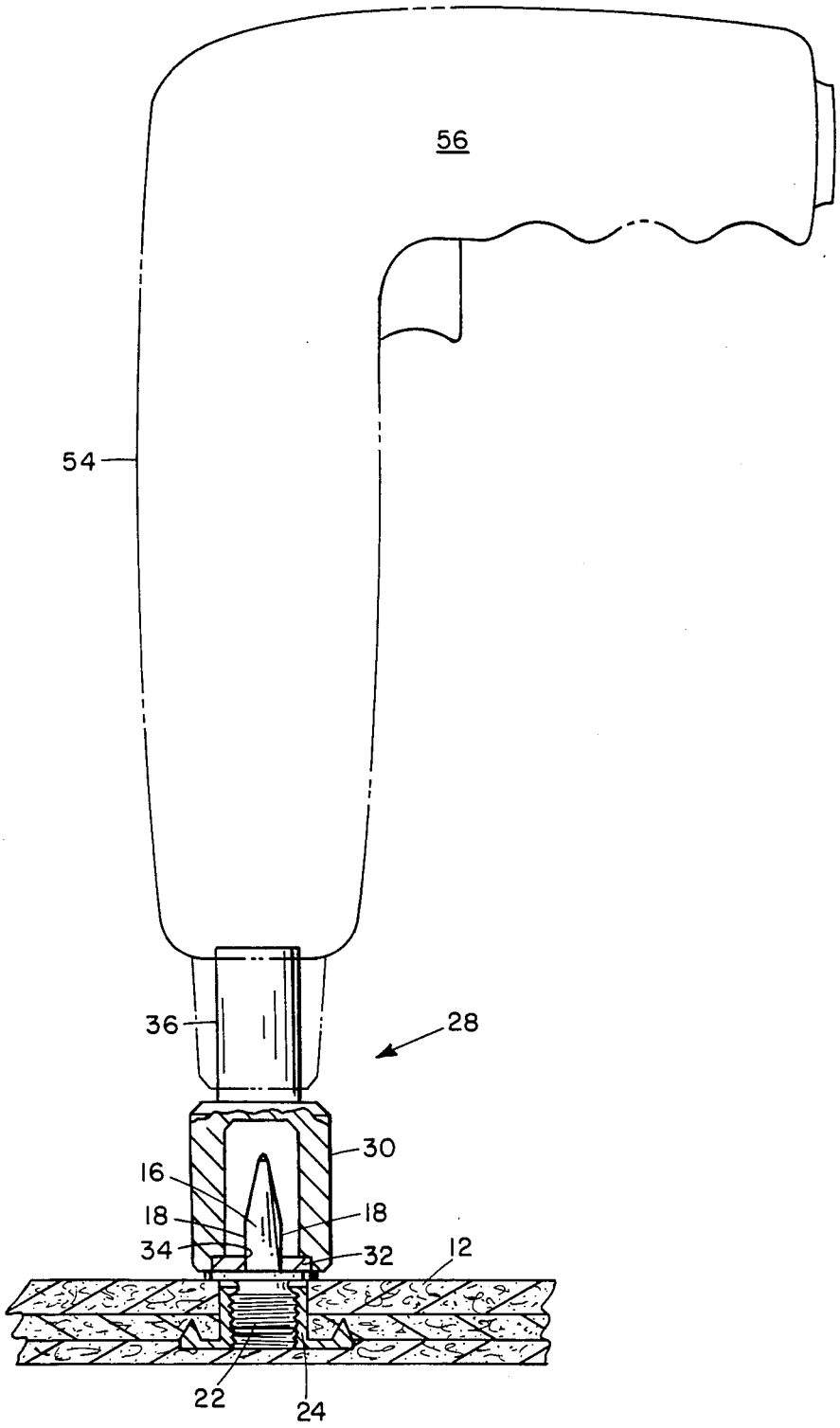
FIG. 5 is a side elevational view of the socket wrench of the present invention disposed over a track shoe spike shown inserted in a track shoe spike socket, with an exemplary electric drill engaging the socket wrench of the present invention.

Referring to FIG. 5, in operation, socket 28 is slipped over the conical spike portion 16 of spikes 10 such that the two opposing substantially flat face surfaces 34 engage the flat or gripping surfaces 18 formed on the base portion of track shoe spikes 10. Socket 28 is engagingly secured by the chuck of an electric drill 56. With the drill in the forward position, opposing surfaces 34 engage flat surfaces 18 and rotate spikes 10 into sockets 24. Reversing drill 56, of course, rotates spikes 10 counterclockwise and thus out of sockets 24. Thus, spikes 10 may be quickly, efficiently, and easily changed.

The socket wrench of the present invention has proven to be an enormous advantage in allowing simple, quick and safe changing of track shoe spikes, and represents a significant advantage over what has been available in the past.

Although the invention has been described in conjunction with the aforegoing specific embodiment, many alternatives, variations and modifications will be apparent to those of ordinary skill in the art. Those alternatives, variations and modifications are intended to fall within the spirit and scope of the appended claims.

I claim:

1. A socket wrench particularly adapted for changing track shoe spikes wherein said track-shoe spikes have engaging surfaces formed thereon and have a threaded portion for mating with threaded socket members disposed in track-shoe soles, and wherein said socket wrench is specially adapted for use in combination with an electric drill, comprising:

a first body member having an axial aperture formed therein of substantially circular shape adapted for insertion of the spike portion of a track-shoe spike;

engaging means adapted to mate with the engaging surfaces of the track-shoe spikes and disposed in said axial aperture for engaging the engaging surfaces of the track-shoe spikes and wherein said engaging means is formed in a circular insert fixedly attached to the interior surface of said axial aperture; and a second body member fixedly attached to said first body member and specially adapted for releasable engagement by the chuck of an electric drill, whereby a track-shoe spike may be changed by disposing said second body member in the chuck of said electric drill, and disposing said first body member over the spike portion of a track-shoe spike until said engaging means engages the engaging surface of said track-shoe spike in such manner as to mate with the engaging surface about the circumference of the spike, and thereafter operating said electric drill so as to insert or remove said track-shoe spike from said socket member disposed in said track-shoe sole.

2. A socket wrench as in claim 1 wherein said engaging means comprises:

a geometrical aperture matching the geometrical shape of the base portion of said track shoe spike.

3. A socket wrench as in claim 1 wherein said engaging means comprises:

two opposing substantially flat face surfaces spaced diametrically from the diameter of said axial aperture, and projecting inwardly from and along parallel chords of said axial aperture.

4. A socket wrench as in claim 3 wherein said engaging means further comprises:

two opposing arcuate surfaces joining the ends of said two opposing substantially flat face surfaces, whereby said two opposing substantially flat face surfaces and said two opposing arcuate surfaces form a geometric aperture having substantially the same geometric shape as the base portion of said track shoe spike.

5. A socket wrench as in claim 1 wherein said engaging means is formed of hardened tool steel.

6. A socket wrench as in claim 1 wherein said engaging means is formed intergrally with said first body portion.

* * * * *